US008915491B2

(12) United States Patent
Meyerhans et al.

(10) Patent No.: US 8,915,491 B2
(45) Date of Patent: Dec. 23, 2014

(54) METHOD FOR OPERATING A COLLECTION MEANS FOR PRINTED PRODUCTS

(75) Inventors: Rolf Meyerhans, Reiden (CH); Thomas Probst, Kestenholz (CH); Roger Stammbach, Reiden (CH); Roger Luescher, Sursee (CH)

(73) Assignee: Mueller Martini Holding AG, Hergiswil (CH)

( * ) Notice: Subject to any disclaimer, the term of this patent is extended or adjusted under 35 U.S.C. 154(b) by 180 days.

(21) Appl. No.: 13/559,827

(22) Filed: Jul. 27, 2012

(65) Prior Publication Data

US 2013/0026003 A1 Jan. 31, 2013

(30) Foreign Application Priority Data

Jul. 29, 2011 (CH) ..... 1270/11

(51) Int. Cl.

| | |
|---|---|
| ***B42C 11/02*** | (2006.01) |
| ***B65H 39/055*** | (2006.01) |
| ***B65H 39/043*** | (2006.01) |
| ***B65H 39/105*** | (2006.01) |

(52) U.S. Cl.

CPC ..... *B65H 39/055* (2013.01); *B65H 39/043* (2013.01); *B65H 39/105* (2013.01); *B65H 2301/437* (2013.01); *B65H 2301/44712* (2013.01); *B65H 2301/44765* (2013.01); *B65H 2301/4318* (2013.01)

USPC ..... 270/52.15; 270/52.14; 270/52.3; 270/52.26; 270/52.27; 270/52.19

(58) Field of Classification Search

CPC ..... B65H 43/08; B65H 43/02

USPC ..... 270/52.14, 52.15, 52.16, 52.17, 52.18, 270/52.19, 52.2, 52.21, 52.22, 52.23, 52.24, 270/52.25, 52.26, 52.27, 52.28, 52.29, 52.3, 270/59

See application file for complete search history.

(56) References Cited

U.S. PATENT DOCUMENTS

| | | | | |
|---|---|---|---|---|
| 3,048,388 | A * | 8/1962 | Smith, Jr. et al. | 270/52.15 |
| 4,168,828 | A * | 9/1979 | McLear | 270/52.29 |

(Continued)

FOREIGN PATENT DOCUMENTS

| | | |
|---|---|---|
| EP | 0588764 A2 | 3/1994 |
| EP | 2107023 A1 | 10/2009 |

(Continued)

OTHER PUBLICATIONS

European Patent Office, European Search Report in European Patent Application No. 12 17 6552.3 (Oct. 15, 2012).

*Primary Examiner* — Patrick Mackey

(74) *Attorney, Agent, or Firm* — Leydig, Voit & Mayer, Ltd.

(57) ABSTRACT

A method for operating a collection system for printed products includes drawing off the printed products from discharge device(s) disposed at corresponding discharge point(s) in the collection system. The printed products are deposited on a collection section during a cycle period of the discharge device(s) so as to form a bundle of printed products. The bundle is transferred to a subsequent conveying mechanism having receiving pockets. It is determined whether at least one missing printed product exists due to an incorrect drawing off from the discharge point(s). A repair process is initiated and controlled in which the at least one missing printed product is drawn off from the corresponding discharge point (s) at a time corresponding to a subsequent recurrent pocket-related cycle of the subsequent conveying mechanism in a subsequent cycle period of the discharge device(s). The at least one missing printed product is inserted in the relevant receiving pocket.

16 Claims, 5 Drawing Sheets

(56) References Cited

U.S. PATENT DOCUMENTS

| | | | | |
|---|---|---|---|---|
| 4,641,825 | A * | 2/1987 | Mowry et al. | 270/52.26 |
| 5,326,209 | A * | 7/1994 | Duke | 412/1 |
| 5,475,968 | A * | 12/1995 | Linder | 53/531 |
| 5,823,320 | A * | 10/1998 | Seidel et al. | 198/803.5 |
| 6,907,316 | B2 * | 6/2005 | Bader et al. | 700/220 |
| 7,284,750 | B2 * | 10/2007 | Glowner | 270/52.14 |
| 7,577,494 | B2 * | 8/2009 | Bader et al. | 700/220 |
| 7,588,236 | B2 * | 9/2009 | Belanger | 270/52.16 |
| 7,845,485 | B2 | 12/2010 | Honegger | |
| 8,191,883 | B2 * | 6/2012 | Bader et al. | 270/52.14 |
| 2005/0116404 | A1 * | 6/2005 | Glowner | 270/52.14 |
| 2005/0182511 | A1 * | 8/2005 | Bader et al. | 700/220 |
| 2010/0200363 | A1 | 8/2010 | Muller | |

FOREIGN PATENT DOCUMENTS

| | | | |
|---|---|---|---|
| WO | WO 0112535 | A1 | 2/2001 |
| WO | WO 2009015503 | A1 | 2/2009 |

* cited by examiner

| | Pos. 21 | | | | | Pos. 20/22 | Pos. 28/24 |
|---|---|---|---|---|---|---|---|
| | | | | | | | |
| | A | B | C | D | E | | |
| 1' | a1' | b1' | c1' | d1' | e1' | a1'- b1'- c1'- d1'- e1' | ➔ |
| 2' | a2' | b2' | c2' | d2' | e2' | a2' - b2'- c2' - d2' - e2' | ➔ |
| 3' | | | | | | | |
| 4' | a4' | b4' | X | d4' | e4' | a4'- b4'- Y- d4'- e4' | ➔ ‖ |
| 5' | | | | | | | |
| 6' | | | | | | | |
| 7' | a7' | b7' | c7' | X | X | a7'- b7'- c7'- Y- Y | ➔ ‖ |
| 8' | | | | | | | |
| 9' | | | | | | | |
| 10' | | | | | | | |
| 11' | | | | | | | |
| 12' | X | X | X | d12' | e12' | Y- Y- Y- d12'- e12' | ➔ ‖ |
| 1" | | | | | | | |
| 2" | a2" | X | X | X | e2" | a2"- Y- Y- Y- e2" | ➔ ‖ |
| 3" | | | | | | | |
| 4" | 0 | 0 | c4" | 0 | 0 | a4'- b4'- d4'- e4'- c4" | ➔ |
| 5" | | | | | | | |
| 6" | | | | | | | |
| 7" | 0 | 0 | 0 | d7" | e7" | a7'- b7'- c7'- d7"- e7" | ➔ |
| 8" | | | | | | | |
| 9" | | | | | | | |
| 10" | | | | | | | |
| 11" | | | | | | | |
| 12" | a12" | b12" | X | 0 | 0 | d12'- e12'- Y- a12"- b12" | ➔ ‖ |
| 1''' | | | | | | | |
| 2''' | 0 | b2''' | c2''' | d2''' | 0 | a2"- e2"- b2'''- c2'''- d2''' | ➔ |
| 3''' | | | | | | | |
| 4''' | | | | | | | |
| 5''' | | | | | | | |
| 6''' | | | | | | | |
| 7''' | | | | | | | |
| 8''' | | | | | | | |
| 9''' | | | | | | | |
| 10''' | | | | | | | |
| 11''' | | | | | | | |
| 12''' | 0 | 0 | c12''' | 0 | 0 | d12'- e12'- a12"- b12"- c12''' | ➔ |

Fig. 6

| | |
|---|---|
| X | defect |
| 0 | not drawn off |
| ➔ | passed on |
| ➔ ‖ | not passed on |
| Y | empty space in pocket |

| | Pos. 21 | | | | | Pos. 20/22 | Pos. 28/24 |
|---|---|---|---|---|---|---|---|
| | | | | | | | |
| | A | B | C | D | E | | |
| 1' | a1' | b1' | c1' | d1' | e1' | a1' - b1'- c1'- d1'- e1' | ➔ |
| 2' | | | | | | | |
| 3' | a3' | b3' | X | 0 | 0 | a3'- b3'- Y- Y- Y | ➔ ‖ |
| 4' | a4' | X | 0 | 0 | 0 | a4'- Y -Y -Y- Y | ➔ ‖ |
| 5' | | | | | | | |
| 6' | | | | | | | |
| 7' | | | | | | | |
| 8' | | | | | | | |
| 9' | | | | | | | |
| 10' | | | | | | | |
| 11' | | | | | | | |
| 12' | | | | | | | |
| 1'' | | | | | | | |
| 2'' | | | | | | | |
| 3'' | 0 | 0 | c3'' | d3'' | e3'' | a3'- b3'- c3'' - d3''- e3'' | ➔ |
| 4'' | 0 | b4'' | X | 0 | 0 | a4' - b4''- Y- Y- Y | ➔ ‖ |
| 5'' | | | | | | | |
| 6'' | | | | | | | |
| 7'' | | | | | | | |
| 8'' | | | | | | | |
| 9'' | | | | | | | |
| 10'' | | | | | | | |
| 11'' | | | | | | | |
| 12'' | | | | | | | |
| 1''' | | | | | | | |
| 2''' | | | | | | | |
| 3''' | | | | | | | |
| 4''' | 0 | 0 | c4''' | d4''' | e4''' | a4'- b4''- c4''' - d4''' - e4''' | ➔ |
| 5''' | | | | | | | |
| 6''' | | | | | | | |
| 7''' | | | | | | | |
| 8''' | | | | | | | |
| 9''' | | | | | | | |
| 10''' | | | | | | | |
| 11''' | | | | | | | |
| 12''' | | | | | | | |

Fig. 7

| | |
|---|---|
| X | defect |
| 0 | not drawn off |
| ➔ | passed on |
| ➔ ‖ | not passed on |
| Y | empty space in pocket |

METHOD FOR OPERATING A COLLECTION MEANS FOR PRINTED PRODUCTS

CROSS-REFERENCE TO PRIOR APPLICATIONS

Priority is claimed to Swiss Patent Application No. CH 01270/11, filed on Jul. 29, 2011, the entire disclosure of which is hereby incorporated by reference herein.

FIELD

The invention relates to a method for operating a collection system for printed products.

BACKGROUND

There are methods for collecting printed products in which the printed products are collected on a collection section. In this process the individual printed sheets or inserts are in each case provided by feeders, then drawn off and finally transferred to the collection section. In the known methods the collection section comprises conveyors, e.g. conveyor belts, which transport the drawn-off printed sheets for further processing.

European Patent Application EP 0588764 discloses a means for collating printed products, which means consists on the one hand of a loading station for feeding covers or cover products into a rotating conveying mechanism, and on the other hand of a supply station for feeding inserts, i.e. printed sheets, into the specified cover products. The end products thus formed, which consist of a cover product and a number of inserts, are taken out of the rotating mechanism by an extraction station and transported to a machine for further processing.

When collecting printed sheets, the aspect of dealing with any defects which arise when drawing off printed sheets from the feeders is particularly important, as this has a considerable impact on the quality and/or processing time for collecting printed sheets in order to produce the end product. Defect handling is therefore an important aspect of such a collection process.

In many existing methods defective products are simply removed, the term "product" in the context of the present invention referring to a collection of printed sheets, and the term "defective" referring to an incomplete, assembled product. The disadvantage of such methods is the high wastage as in most cases the rejected products cannot be re-used. European Patent Application EP 2 107 023 represents a further development in that it discloses a method and a device for conveying flat products. Defective products are not removed in this process, as was the case previously, but are fed back into the collection section by means of a revolving conveyor, completed in this section and then passed on for further processing. The disadvantage of this solution is the complicated system for returning the defective end products, which makes the system more expensive.

SUMMARY

In an embodiment, the present invention provides a method for operating a collection system for printed products. The printed products are drawn off from at least one discharge device disposed at a corresponding at least one discharge point in the collection system. The printed products are deposited one after the other on a collection section during a cycle period of the at least one discharge device so as to form a bundle of printed products from the printed products that were drawn off during the cycle period. The bundle is transferred to a subsequent conveying mechanism having a plurality of receiving pockets at a transfer station on the collection section. It is determined whether at least one missing printed product exists due to an incorrect drawing off from the at least one discharge point such that a relevant receiving pocket is incompletely loaded with the printed products. A repair process is initiated and controlled in which the at least one missing printed product is drawn off from the corresponding at least one discharge point at a time corresponding to a subsequent recurrent pocket-related cycle of the subsequent conveying mechanism in a subsequent cycle period of the at least one discharge device. The at least one missing printed product is inserted in the relevant receiving pocket.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. Like components are designated by like numerals in the figures. The features and advantages of various embodiments of the present invention will become apparent by reading the following detailed description with reference to the attached drawings which illustrate the following:

FIG. 6 shows a first table with sequences in the repair of a defective end product in the event of sample defects without considering the initially intended structure of the bundle, and FIG. 7 shows a second table with sequences in the repair of a defective end product in the event of sample defects where the initially intended structure of the bundle is retained.

DETAILED DESCRIPTION

Figure 1:
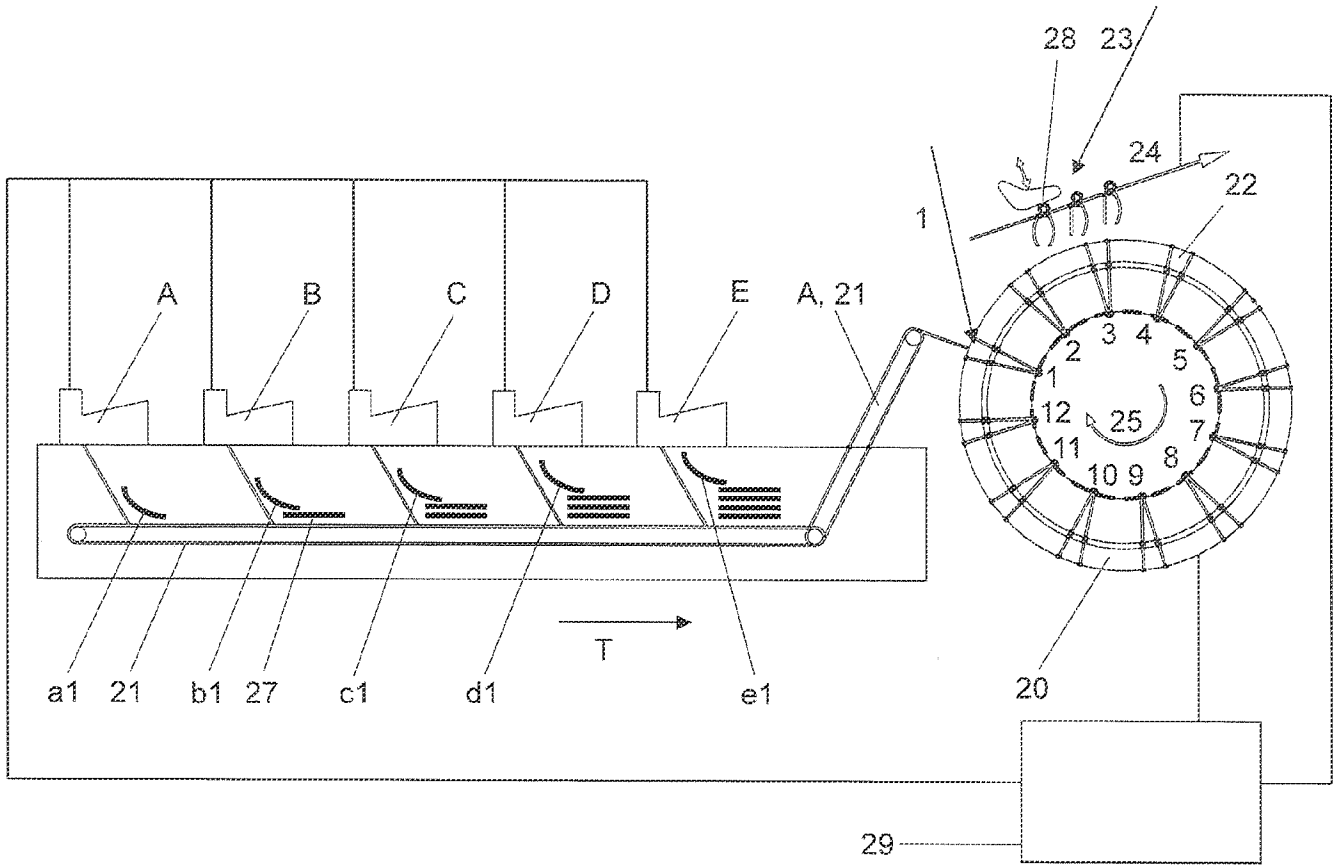
FIG. 1 shows a simplified side view of an embodiment of a device for carrying out the method according to the invention.
Figure 3:
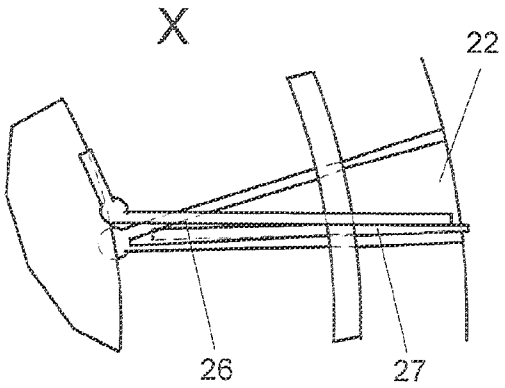
FIG. 3 shows a detailed view of part of the conveying mechanism according to FIG. 2.

In theory, it would be possible to conceive of a logistical process in which additional discharge points are provided and which come into play if drawing off printed products via the ordinary discharge points leads to missed products. Such a configuration would merely have to provide as many replacement discharge points as the number of ordinary operational discharge points. However, this alone would not cover all eventualities since a discharge point intended as a replacement for the "repair process" could itself fail in extreme cases, thus causing the bundle to have to be rejected as defective in the long run. Even this solution therefore does not represent a sustainable repair process.

In an embodiment, the invention remedies this situation by a method for collecting printed products that provides "repair" to defective end products in an efficient and cost-effective manner.

According to an embodiment, the present invention provides a method for collecting a number of flat products, especially printed sheets, in which the products are in each case discharged to the conveyor at an assigned discharge point along a moving conveyor by a discharge device which preferably consists of at least one feeder. In this process an end product is formed after collecting all products from the discharge device and this is transferred from the conveyor to a conveying mechanism at a transfer station, this conveying mechanism then transporting the end product on to a system for further processing.

According to an embodiment of the invention, the product discharge device consists of at least one feeder from which one insert is generally drawn off. If the product discharge device consists of more than one feeder arranged in sequence, the corresponding bundle is formed by the number of drawn-off inserts. This bundle is then transferred to a further conveying device which preferably consists of a rotating conveying mechanism which comprises a number of pockets in the circumferential direction, each of which is designed to hold the described bundle.

Viewed in this light, this leads to a cyclic interdependency between the formation of the individual insert bundle formed by the feeders and the rotating cycle of the pockets. This cyclic interdependency is referred to below as a cycle period.

In the example below, assuming a collection system with five feeders, this therefore means that, on the one hand, a cycle period consists of the time required to form an insert bundle, and on the other hand it also consists of the time required for the pocket to cover its angle of rotation. The time required for this angle of rotation is thus dependent on the number of pockets in the circumferential direction and on the rotation speed of the rotating conveying component. The same conditions obviously also apply if the conveying mechanism does not operate in a rotary movement, but in a different kind of translational motion.

An embodiment of the invention now proposes procedural sequences which always come into play when a "repair process" is pending or needs to come into play, i.e. whenever defects arise within the feeders during the product discharge process which lead to an incomplete end product. In the case of a product discharge device consisting of a number of feeders, an insert may not be drawn off correctly in certain configurations, causing the bundle to be created at the end of the collection section to be incomplete, as a result of which the end product itself would have to be rejected for quality reasons.

There are thus two basic models when operating the method with a view to adding the missing printed sheets to the incomplete end product during continuous operation:

Firstly, an embodiment of the invention proposes a process in which the inserts missing from the collated bundle can be added in the next cycle, without having to consider the structure of the bundle which is subsequently transferred onwards. In such a case, the missing insert(s) is/are simply supplied during a subsequent cycle, the discharge device only drawing off, in order, those inserts which are missing from the incomplete bundle during such a cycle so that the relevant incompletely loaded pocket, which is in the transfer position in accordance with the cycle, i.e. at the same time, can be loaded.

Therefore, when the pocket containing an incomplete bundle passes its loading position, the missing inserts, which have now been drawn off and are waiting, are inserted in the pocket.

The next pocket, which still needs to be loaded, is of course loaded correctly with the next full bundle.

Only when the end product is complete is removal from the corresponding pocket initiated.

If, however, there is still an incomplete bundle of inserts after an initial "repair", removal is still not initiated and the relevant incompletely loaded pocket remains in circulation until the next "repair process".

Secondly, an embodiment of the invention is concerned with a process in which the structure of the bundle formed by the inserts needs to be retained in the end product as a result of inserts being drawn off incompletely, i.e. the stacked order of the various inserts must have the specified order in the end product.

To this end, whenever an insert is not drawn off, a control system comes into play when drawing off the subsequent inserts to ensure that no more inserts are drawn off during this cycle.

The pocket assigned to this cycle is thus merely loaded with the inserts which were drawn off correctly in order until the missing insert discharge.

If, for example, the first insert cannot be drawn off, the relevant pocket is not loaded with any more inserts in the first instance. This pocket must then be filled during the next revolution, i.e. as a general rule, in the next period of the rotating mechanism.

It may be that the missing inserts may once again not be able to be inserted in order after the first "repair". Again in this case, the control system will stop the drawing off of subsequent inserts within the current cycle of the discharge device as soon as the drawing-off process has not taken place successfully from one feeder. Inserts which have not yet been drawn off are then fed into the relevant pocket during the next revolution.

This procedure thus ensures that the structure of the end product is guaranteed irrespective of the number of stacked inserts and irrespective of the number of "repair processes" which need to be controlled.

One main advantage of an embodiment of the invention is that a complicated return of the defective end products is not necessary and the "repairs" performed form an integral part of the product assembly process.

FIG. 1 shows a collection system for carrying out the method according to an embodiment of the invention. The system comprises a collection section for printed sheets 27 to the left of a transfer station 1 as shown in the figure and a rotating conveying mechanism 20 to the right of the transfer station. The conveying mechanism 20 rotates in the direction shown by the arrow 25.

The collection section comprises a conveyor 21 which in this case consists of an endless conveyor belt, but this can of course also consist of several conveyor belts. Conveyor belt 21 moves in the transport direction T at a defined operating speed. The collection section also comprises a number of discharge devices A, B, C, D, E, which are specifically designed as feeders. Feeders A-E are intended to deposit printed sheets onto the conveyor belt 21 at a discharge point, this happening within a defined cycle period, thus ensuring that the printed sheets 27 can be stacked from the respective feeder as the conveyor belt 21 runs along the discharge section. The time between two printed sheets 27 being deposited from one and the same feeder is known as the cycle period throughout the application text. In this particular example, stacks of five printed sheets 27 are thus formed, the stacks of printed sheets being referred to below as bundles. The bundles consisting of stacked printed sheets then reach a transfer station 1 where they are transported to a receiving pocket 22 in the rotating conveying mechanism 20.

If the pocket already contains a cover product supplied by an additional transport section, the bundles of printed sheets and the cover product form the end product. Otherwise, the individual bundle of printed sheets forms the end product. The rotating conveying mechanism 20 continues to rotate the end product until this is subsequently picked up at a suitable point by a gripper 28 from a delivery chain 24 of a further processing system 23, removed from the receiving pocket and transported on for further processing. In this process, the rotation speed of the rotating conveying mechanism 20 is synchronised with the speed of the conveyor 21 such that no more than one end product is discharged into one receiving pocket 22 of the rotating conveying mechanism 21 at the transfer station 1 during a cycle period. In other words, a receiving pocket 22 in the conveying mechanism 20 remains at the transfer station 1 for a maximum of one cycle period whilst the end products are supplied from the conveyor 21. The receiving pockets are numbered from 1 to 12 in this case.

Feeders A-E, the rotating conveying mechanism 20 and the grippers 28 from the delivery chain 24 are controlled by a control system 29 and equipped such that they can at least transmit items of status information to the control system 29. This is explained in greater detail when explaining a "repair" in the event of a defect.

In the event of a defect, i.e. in the event of one or more of the feeders A-E being unable to draw off printed sheets 27 and deposit these on the stacks of printed sheets, the end product, i.e. the bundle of printed sheets at the very least, is incomplete and therefore defective. In this case, the defective end product thus formed is not passed on once it has been accepted by the conveying mechanism 20, but remains in circulation. This thus prevents the gripper 28 being able to remove the defective end product from the receiving pocket 22. This can either be achieved in that the gripping function of the gripper 28 does not come into operation for the defective end product or in that the defective end product is drawn so far inside the receiving pocket that the gripper 28 grips at nothing. These two options make it possible to use a variety of grippers or conveying mechanism systems which are already in existence. For example, the second alternative can be used if the delivery chain 24 does not have a controllable gripping function. Other options which are not described here for removing or preventing the removal of an end product are of course also possible. In the present embodiment, the incomplete end product is thus retained in the conveying mechanism 20 for a further revolution once extraction has been prevented, a retaining device being used to ensure that the product cannot fall out of the pocket. These sequences are explained in greater detail in FIGS. 2 to 5.

Figure 2:
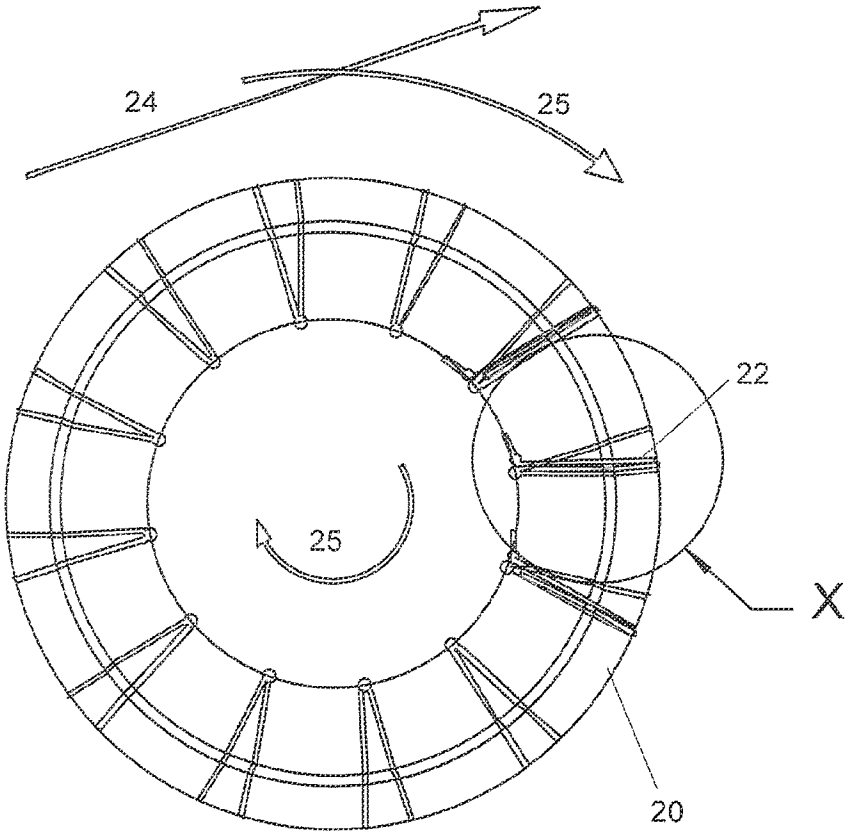
FIG. 2 shows a side view of a first embodiment of a conveying mechanism.
Figure 5:
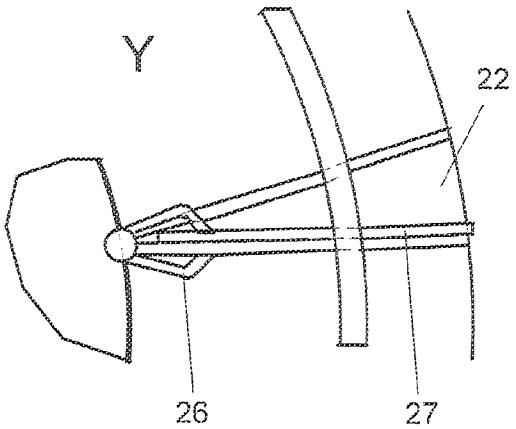
FIG. 5 shows a detailed view of part of the conveying mechanism according to FIG. 4.

FIG. 2 shows a side view of a first embodiment of a rotating conveying mechanism 20 with receiving pockets 22. X represents a detail of a receiving pocket in the conveying mechanism 20 which is shown in enlarged form in FIG. 3. The receiving pocket 22 contains a printed sheet 27 and comprises a retaining device 26 which is in the form of a flap and presses the printed sheet 27 against a wall of the receiving pocket 22 as soon as this is completely inserted in the receiving pocket 22.

Figure 4:
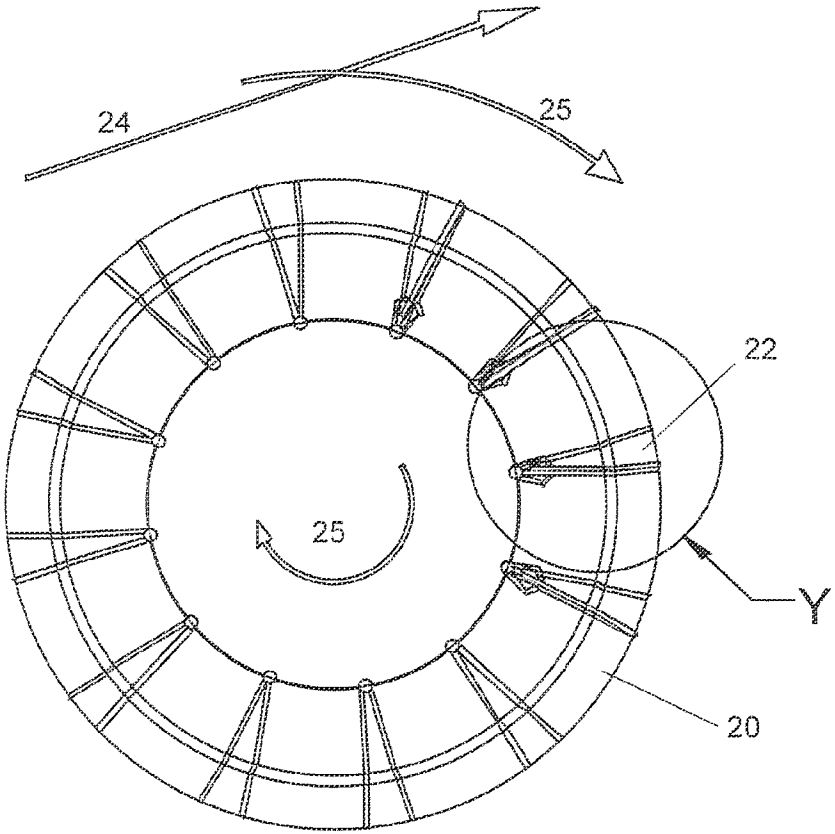
FIG. 4 shows a side view of a second embodiment of a conveying mechanism.

Like FIG. 2, FIG. 4 shows a side view of a second embodiment of a conveying mechanism 20 with receiving pockets 22. Y represents a detail of a receiving pocket in the conveying mechanism 20 which is shown in enlarged form in FIG. 5. The receiving pocket 22 contains a printed sheet 27 and comprises a retaining device 26 which is in the form of a clamp in this embodiment and clamps the printed sheet together with a wall of the receiving pocket 22 as soon as the printed sheet 27 is completely inserted in the receiving pocket 22.

FIG. 6 is a graphic representation of the "repair sequence" in the collection system in which the inserts missing from a bundle can be added without restricting the cyclic sequence of the rotating mechanism 20. In this "repair process" the structure of the bundle of inserts which is ultimately passed on is not important. In this case it is simply a question of passing on complete bundles. In such a case, the missing insert(s) is/are simply supplied in that the discharge device only draws off those inserts which are missing from the incomplete bundle which is already on "standby" in a pocket during a cycle. In other words, when the pocket containing an incomplete bundle passes its loading position, the missing inserts, which have now been drawn off and are waiting, are inserted in this pocket. The next pocket in the cycle is of course loaded correctly with the inserts which have been drawn off completely. Once the inserts are located around the full circumference, there is nothing to prevent removal of the end product from the rotating mechanism 20 via the devices 24/28. If, however, there is still an incomplete bundle of inserts after an initial complete "repair process", removal is still not performed and the pocket is added to as described during the next revolution.

FIG. 6 shows such a process using assumed examples. The following clarifications may prove necessary: the left-hand column 21 shows a series of cycles which comply with the cyclic sequence of the rotating mechanism 20 on the assumption that this mechanism 12 has a number of pockets. The number of pockets in a rotating mechanism 20 or a mechanism 20 set up on the basis of displacement motion may of course be greater, but this does not change anything in respect of the "repair process".

In this case it is assumed that the pockets 22 will be loaded during three consecutive revolutions identified by the number of apostrophes. For each pocket 22 to be loaded in order, the discharge device, which is in this case equipped with five feeders A-E, for example, draws off five inserts $a_1$, $b_1$, $c_1$, $d_1$, $e_1$ which form a bundle for a first waiting pocket. The same process applies for the remaining pockets 2 to 12, and also during subsequent revolutions of the mechanism 20. It may be that an insert is not or cannot be drawn off from a feeder (shown as "X" in the figure), with the result that the bundle of inserts for the next pocket in the cycle is incomplete, which means that corresponding empty spaces "Y" are formed in the receiving pocket, as shown in the figure.

In this case such a configuration is illustrated in FIG. 6 in the fourth cycle of the first revolution (4'). In this case, feeder C does not deliver an insert c, i.e. insert $c_4$ is missing and the bundle is therefore incomplete. In this initial situation, the incomplete bundle therefore remains in the relevant pocket in the waiting position for at least one more revolution of the mechanism 20. The control system prevents the incomplete contents of this receiving pocket being passed on, as shown in the figure by means of two vertical lines after the arrow.

FIG. 6 now shows how such a "repair" is performed. In the next revolution, which is identified by two apostrophes (4"), feeders A, B, D, E do not draw off any inserts (shown as "0" in the figure) and only feeder C is active, drawing off an insert $c_4$ intended for the fourth cycle, this being inserted in receiving pocket 4 as it passes, with the result that the bundle of inserts consisting of inserts a, b, d and e from the first revolution is supplemented by insert c from the second revolution. FIG. 6 also shows that this insert c does not comply with the original order of the bundle, but is merely added to the other inserts at the end.

FIG. 6 also shows further examples of "repairs" in order to prove the stability of the system, i.e. the "repair process". Defects arising during the seventh cycle of a first revolution (7') are illustrated in which inserts d and e are not or cannot be drawn off, as marked by X. In the next revolution, also during the seventh cycle (7"), only the missing inserts d and e are drawn off and added to the corresponding receiving pocket as it rotates past, in addition to inserts a, b and c from the previous revolution which are already there. Inserts d and e which are drawn off last are also simply added to the existing partial bundle.

The procedure is also shown in the event of it not being possible to complete the "repair" immediately in the next revolution, for example, and where an additional repair revolution needs to be carried out for the relevant pocket.

This relates to the 12th cycle during the first revolution (12'). Inserts $a_1$, $b_1$, $c_1$ cannot be drawn off ("X"), which means that only inserts d and e which have been drawn off can reach the corresponding pocket. In the next revolution (12") the "repair" cannot be executed completely because insert c still cannot be drawn off from feeder C, for example. In other words, the bundle of printed sheets is still not complete and has to remain in the pocket for a further revolution. Only in the next revolution (12''') can insert c be drawn off, with the result that the bundle in the corresponding pocket is now complete and can be passed on accordingly, as shown in the figure with just one arrow. Note the order of inserts in this context, consisting of inserts d and e from the first revolution, then inserts a and b from the second revolution and finally insert c from the third revolution in accordance with the order in which they were inserted. The "repair process" is also illustrated by way of example if defects only occur during a subsequent revolution in a specific cycle for example. During the second revolution, only feeders A and E may draw off inserts in the second cycle. The other feeders B, C, D do not supply any inserts b, c, d. The "repair" is then performed in the subsequent revolution and the missing inserts b, c and d are then supplied and added to the existing inserts in the corresponding pocket.

FIG. 7 shows a process which provides a solution if the ordered structure of the bundle of inserts needs to be retained in the end product in all cases following incomplete drawing off of the inserts, i.e. the desired order of stacked inserts must be guaranteed in the end product. Reference is made to the explanations for FIG. 6 for operational states "X", "0" and "Y" in FIG. 7.

To this end, a control system in turn comes into play, in association with FIG. 6, whenever a defect occurs, i.e. whenever an insert is not drawn off, but this is now programmed to come into play, when drawing off the next inserts to be delivered, in such a way that the feeders immediately afterwards do not supply any more inserts during the current cycle in the event of an insert failing to be drawn off. The pocket assigned to this cycle is thus merely loaded with the inserts which were drawn off in order, corresponding to the feeder order until the failed discharge. If, for example, the first insert cannot be drawn off, there is initially no insert available to be loaded in the relevant pocket. This pocket must then be filled during the next revolution of the rotating mechanism.

It may be that the missing inserts may once again not be completely drawn off in order after the first "repair". Once again in this case, the control system will prevent the drawing off of subsequent inserts within the current cycle and the inserts not yet drawn off will then be added during the next revolution. This procedure thus ensures that the ordered structure of the end product is always guaranteed irrespective of the number of stacked inserts and irrespective of the number of "repair" processes which need to be controlled.

FIG. 7 shows selected examples of this "repair process". As shown, all inserts from the corresponding feeders are drawn off correctly during the first cycle, meaning that they can be passed on as a complete bundle. If insert c cannot be drawn off correctly during the first revolution in cycle 3, the remaining inserts, d and e, are not drawn off immediately afterwards by corresponding control measures, even if the drawing-off process could take place correctly. In the next revolution the missing inserts c, d and e are drawn off as a continuous partial bundle and added to the corresponding pocket. As there are now two partial bundles in this pocket, i.e. (a, b) and (c, d, e), they are joined together in the originally intended order. In the fourth cycle of the first revolution, for example, insert b is not drawn off from feeder B. The control system comes into play immediately and prevents the next inserts, c, d and e being drawn off. If insert b can then be drawn off in the next revolution, but not the following insert c, the control system comes into play again and prevents the next inserts d and e being drawn off. In this initial position, inserts a and b are in the corresponding pocket, stacked in the correct order. Only in the next revolution can the remaining inserts, c, d and e be drawn off in one go, in order, meaning that they can now be successfully added to the incomplete pocket.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

What is claimed is:

1. A method for operating a collection system for printed products, the method comprising:

drawing off the printed products from at least one discharge device disposed at a corresponding at least one discharge point in the collection system;

depositing the printed products one after the other on a collection section during a cycle period of the at least one discharge device so as to form a bundle of printed products from the printed products that were drawn off during the cycle period;

transferring the bundle to a subsequent conveying mechanism having a plurality of receiving pockets at a transfer station on the collection section, determining whether at least one missing printed product exists due to an incorrect drawing off from the at least one discharge point such that a relevant receiving pocket is incompletely loaded with the printed products;

initiating and controlling a repair process in which the at least one missing printed product is drawn off from the corresponding at least one discharge point at a time corresponding to a subsequent recurrent pocket-related cycle of the subsequent conveying mechanism in a subsequent cycle period of the at least one discharge device; and inserting the at least one missing printed product in the relevant receiving pocket, wherein the subsequent conveying mechanism includes a rotating drive wheel having at least one of a number n of the receiving pockets around its circumference and an endless belt equipped with the receiving pockets.

2. The method according to claim 1, wherein a rotation speed of the subsequent conveying mechanism is synchronized with an operating speed of the collection section such that no more than a single bundle, a single partial bundle or a single one of the at least one missing printed product is discharged into one of the receiving pockets in the cycle period of the at least one discharge device.

3. The method according to claim 1, further comprising initiating subsequent ones of the repair process to prepare a complete bundle, a number of the subsequent repair processes corresponding to at least a number of the at least one discharge point.

4. The method according to claim 1, wherein the bundle having the at least one missing printed product is prevented from falling out of the relevant receiving pocket by at least one of a retaining device and a clamping device after the bundle has been deposited in the relevant receiving pocket and during onwards motion of the subsequent conveying mechanism in the repair process.

5. The method according to claim 1, wherein a speed of the subsequent conveying mechanism is a function of a number of the plurality of receiving pockets compared with a number of the at least one discharge point.

6. The method according to claim 5, wherein a cycle period of the subsequent conveying mechanism from receiving pocket to receiving pocket is greater than, equal to or less than the cycle period of the at least one discharge device.

7. The method according to claim 5, wherein the speed of the subsequent conveying mechanism is modified during operation.

8. The method according to one or more of claim 1, wherein a repair process which is not designed in accordance with an order of printed products is converted to a repair process structured in accordance with the order of printed products and that the repair process structured in accordance with the order of printed products is converted to the repair process which is not designed in accordance with the order of printed products.

9. A method for operating a collection system for printed products, the method comprising:

drawing off the printed products from discharge devices disposed at corresponding discharge points in the collection system;

depositing the printed products one after the other on a collection section during a cycle period of the discharge devices so as to form a bundle of printed products from the printed products that were drawn off during the cycle period;

transferring the bundle to a subsequent conveying mechanism having a plurality of receiving pockets at a transfer station on the collection section, determining whether at least one missing printed product exists due to an incorrect drawing off from at least one of the discharge points such that a relevant receiving pocket is incompletely loaded with the printed products, wherein other ones of the discharge devices located along the collection section after the at least one of the discharge points, during the depositing, do not supply printed products;

initiating and controlling a repair process in which the at least one missing printed product is drawn off from the at least one of the discharge points, in an order of the discharge devices along the collection section, at a time corresponding to a subsequent recurrent pocket- related cycle of the subsequent conveying mechanism in a subsequent cycle period of the discharge devices; and inserting the at least one missing printed product in the relevant receiving pocket wherein the subsequent conveying mechanism includes a rotating drive wheel having at least one of a number n of the receiving pockets around its circumference and an endless belt equipped with the receiving pockets.

10. The method according to claim 9, wherein a rotation speed of the subsequent conveying mechanism is synchronized with an operating speed of the collection section such that no more than a single bundle, a single partial bundle or a single one of the at least one missing printed product is discharged into one of the receiving pockets in the cycle period of the discharge devices.

11. The method according to claim 9, further comprising initiating subsequent ones of the repair process to prepare a complete bundle, a number of the subsequent repair processes corresponding to at least a number of the discharge points.

12. The method according to claim 9, wherein the bundle having the at least one missing printed product is prevented from falling out of the relevant receiving pocket by at least one of a retaining device and a clamping device after the bundle has been deposited in the relevant receiving pocket and during onwards motion of the subsequent conveying mechanism in the repair process.

13. The method according to claim 9, wherein a speed of the subsequent conveying mechanism is a function of a number of the plurality of receiving pockets compared with a number of the discharge points.

14. The method according to claim 13, wherein a cycle period of the subsequent conveying mechanism from receiving pocket to receiving pocket is greater than, equal to or less than the cycle period of the discharge devices.

15. The method according to claim 13, wherein the speed of the subsequent conveying mechanism is modified during operation.

16. The method according to one or more of claim 9, wherein a repair process which is not designed in accordance with an order of printed products is converted to a repair process structured in accordance with the order of printed products and that the repair process structured in accordance with the order of printed products is converted to the repair process which is not designed in accordance with the order of printed products.

* * * * *